US005617948A

United States Patent [19]

Rainey

[11] Patent Number: 5,617,948

[45] Date of Patent: Apr. 8, 1997

[54] JEWELRY STORAGE APPARATUS

[76] Inventor: Claudette Rainey, 3905 Vineyard Rd., Kansas City, Mo. 64130

[21] Appl. No.: 370,382

[22] Filed: Jan. 9, 1995

[51] Int. Cl.[6] ..... A45C 11/04

[52] U.S. Cl. ..... 206/6.1; 206/566; 206/523; 206/5

[58] Field of Search ..... 206/6.1, 495, 523, 206/566, 5, 770; 428/71, 74, 76; 190/125; 5/420, 481

[56] References Cited

U.S. PATENT DOCUMENTS

| | | | |
|---|---|---|---|
| 830,577 | 9/1906 | Devine . | |
| 2,222,772 | 11/1940 | Jefferson . | |
| 2,380,052 | 7/1945 | Koller, Jr. . | |
| 2,861,682 | 11/1958 | Hatcher . | |
| 3,280,972 | 10/1966 | Thomas | 206/495 |
| 3,344,973 | 10/1967 | Studen | 206/523 |
| 3,900,060 | 8/1975 | Shammas | 206/6.1 |
| 4,181,224 | 1/1980 | Aber . | |
| 4,350,249 | 9/1982 | Caston | 206/566 |
| 4,432,456 | 2/1984 | Ovadia et al. . | |
| 4,733,775 | 3/1988 | Fireman | 206/5 |
| 4,874,446 | 10/1989 | Elkin | 206/566 |
| 4,930,635 | 6/1990 | Hotchkiss et al. | 206/6.1 |
| 4,951,334 | 8/1990 | Maier | 5/481 |
| 4,993,545 | 2/1991 | Feiler . | |
| 5,074,409 | 12/1991 | Elkin et al. | 206/566 |
| 5,139,838 | 8/1992 | Baum | 428/76 |
| 5,252,377 | 10/1993 | Poll | 206/566 |
| 5,527,091 | 6/1996 | Gruber . | |

FOREIGN PATENT DOCUMENTS

| | | | |
|---|---|---|---|
| 1270424 | 10/1960 | France . | |
| 2653978 | 5/1991 | France | 206/6.1 |
| 4016806 | 11/1991 | Germany | 206/6.1 |
| 9015557 | 12/1990 | WIPO . | |

*Primary Examiner*—David T. Fidei
*Attorney, Agent, or Firm*—Hovey, Williams, Timmons & Collins

[57] ABSTRACT

A jewelry storage device for holding and displaying jewelry is provided. The jewelry storage device includes a multilayered jewelry cushion for receiving and holding the posts of jewelry such as earrings or pins and a transparent carrying case for receiving the jewelry cushion and for allowing visual inspection of the jewelry held on the cushion when the cushion is placed within the carrying case.

3 Claims, 1 Drawing Sheet

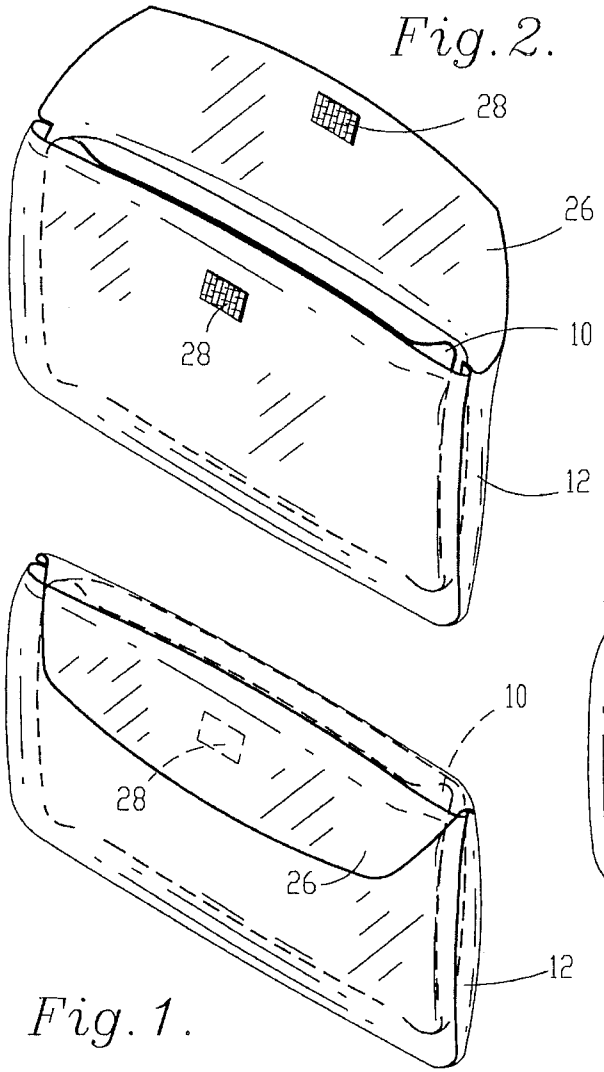
Fig. 1.
Fig. 2.
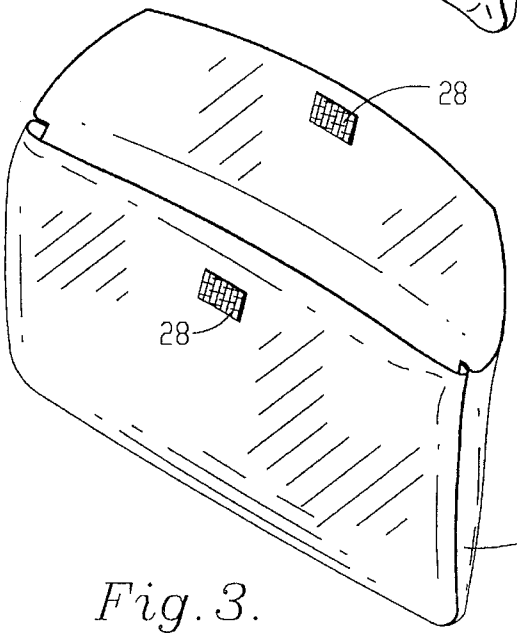
Fig. 3.
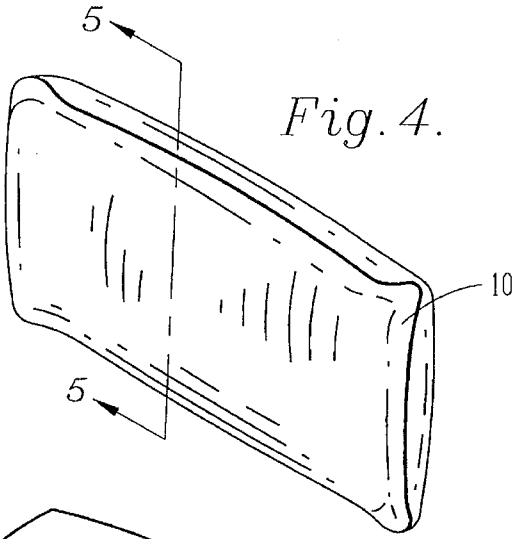
Fig. 4.
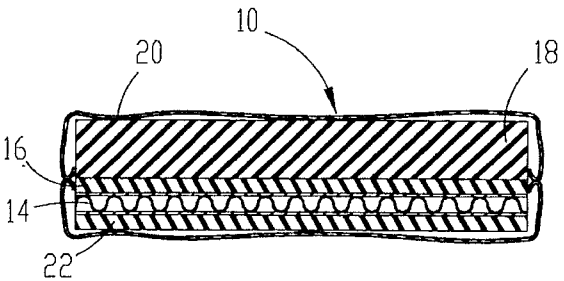
Fig. 5.
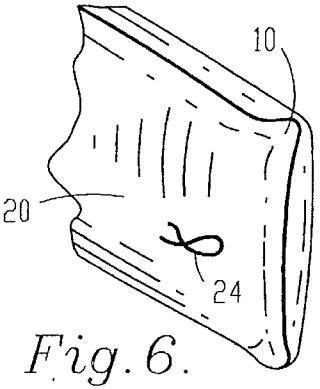
Fig. 6.

JEWELRY STORAGE APPARATUS

BACKGROUND OF THE INVENTION

1. Field of the Invention

The present invention is related to jewelry storage devices for holding and displaying jewelry such as earrings and pins. More particularly, the invention is related to a jewelry storage device including a multilayered jewelry cushion for receiving and holding the posts of jewelry and a transparent carrying case for enclosing the jewelry cushion and for allowing visual inspection of the jewelry held on the cushion when the cushion is placed within the carrying case.

2. Description of the Prior Art

Jewelry storage devices for storing and displaying jewelry are known in the art. Prior art jewelry storage devices typically include a jewelry cushion that receives and holds the posts of jewelry such as earrings and pins. These jewelry cushions typically include a layer of sponge material mounted on a rigid backing layer surrounded by an outer cloth layer. The posts of the jewelry are pushed through the outer layer so that they penetrate a portion of the sponge layer. The sponge grips the jewelry posts so that the jewelry does not fall off of the cushion.

Prior art jewelry storage devices suffer from several limitations which limit their utility. For example, although these jewelry cushions effectively receive and hold jewelry while positioned in a horizontal position, they are ineffective when moved or placed in a vertical position. It is often desirable to transport jewelry cushions by placing them in a purse or other bag. With prior art jewelry cushions, the jewelry often falls off of the cushion when the cushion is jostled around within the bag. This frequently results in the loss of valuable jewelry.

To prevent the loss of jewelry, prior art jewelry storage devices are often provided with a separate carrying case that receives and envelops the jewelry cushion for use when transporting the jewelry cushion. Although these carrying cases prevent jewelry from falling off of the jewelry cushion, they create new limitations. For example, once the jewelry cushion is placed in the carrying case, the jewelry attached thereto is removed from view. Thus, it is impossible to determine what jewelry is attached to the cushion without removing the cushion from the carrying case.

Accordingly, there is a need for an improved jewelry storage device which overcomes the limitations of prior art jewelry storage devices.

OBJECTS AND SUMMATY OF THE INVENTION

In view of the limitations of prior art jewelry storage devices discussed above, it is an object of the present invention to provide a jewelry storage device including a jewelry cushion that effectively holds jewelry such as earrings and pins.

It is another object of the present invention to provide a jewelry storage device that includes a carrying case that receives and envelops the jewelry cushion to prevent jewelry from dislodging from the jewelry cushion during transport.

It is another object of the present invention to provide a jewelry storage device that includes a transparent carrying case for allowing visual inspection of the jewelry held on the cushion when the cushion is placed within the carrying case.

In accordance with these and other objects evident from the following description of a preferred embodiment of the invention, an improved jewelry storage device is provided that effectively holds and displays jewelry while allowing visual inspection of jewelry attached thereto. The preferred jewelry storage device broadly includes a multilayered jewelry cushion for holding and displaying jewelry and a transparent carrying case for receiving the jewelry cushion for easy handling and transport.

In more detail, the multilayered jewelry cushion is operable for receiving and holding the posts of jewelry such as earrings and pins. The jewelry cushion includes a planar base layer formed of thin rigid cardboard or corkboard material, a planar intermediate layer formed of pliable foam rubber material positioned atop the base layer, a planar upper layer formed of sponge material positioned atop the intermediate layer, and an outer layer formed of flexible cloth material that envelops the base, intermediate and upper layers. A second layer of foam rubber material may be positioned below the base layer to conceal the base layer and to give the overall jewelry cushion a softer feel.

The layers of the jewelry cushion cooperate to firmly hold the posts of the jewelry attached thereto while allowing a person to easily remove the jewelry from the cushion for use. The outer layer may also include a plurality of loops attached thereto for receiving and holding jewelry such as loop earrings.

The carrying case is provided for receiving and enveloping the jewelry cushion to prevent jewelry from dislodging from the jewelry cushion during transport. The carrying case is formed of transparent plastic sheet material which allows visual inspection of the jewelry attached to the cushion when the cushion is placed within the carrying case.

By providing the above described construction in accordance with the present invention, numerous advantages are realized. For example, by providing a jewelry cushion that includes a rigid base layer, a pliable intermediate layer, and a sponge-like upper layer, the jewelry storage device effectively holds the posts of the jewelry attached thereto while allowing a person to easily remove the jewelry from the cushion for use.

Additionally, by providing a carrying case which envelops the jewelry cushion, jewelry attached to the jewelry cushion won't dislodge when the jewelry cushion is placed in a purse or other bag. Additionally, since the carrying case is formed of transparent material, the jewelry attached to the cushion can be visually inspected without removing the cushion from the carrying case.

BRIEF DESCRIPTION OF THE DRAWING FIGURES

A preferred embodiment of the present invention is described in detail below with reference to the attached drawing figures, wherein:

FIG. 1 is a perspective view of a jewelry storage apparatus constructed in accordance with the preferred embodiment;

FIG. 2 is a perspective view of the apparatus shown with the cover panel of the carrying case unfastened;

FIG. 3 is a perspective view of the apparatus shown with the jewelry cushion removed from the carrying case;

FIG. 4 is a perspective view of the jewelry cushion of the apparatus;

FIG. 5 is a section view of the jewelry cushion of the apparatus taken along line 5—5 of FIG. 4; and FIG. 6 is a partial view of the jewelry cushion illustrating a loop sewn to the outer layer.

DETAILED DESCRIPTION OF THE PREFERRED EMBODIMENTS

Turning now to the drawing, and particularly FIG. 1, a jewelry storage device constructed in accordance with the preferred embodiment of the present invention is illustrated. The jewelry storage device is adapted to hold and display jewelry such as earrings and pins. The preferred jewelry storage device is sized to fit within a purse or other small bag, but may also be sized for use as a table-top jewelry storage device.

The jewelry storage device broadly includes a jewelry cushion 10 for holding jewelry and a transparent carrying case 12 for receiving and enveloping the jewelry cushion so that the jewelry cushion can be placed in a purse or other bag.

In more detail, the jewelry cushion 10 is operable for receiving and holding the posts of jewelry such as earrings and pins. As illustrated in FIG. 5, the jewelry cushion 10 includes a planar base layer 14, a planar intermediate layer 16, a planar upper layer 18, and a cover layer 20. As described in detail below, the multiple layers of the jewelry cushion 10 cooperate to firmly hold the posts of jewelry attached thereto while allowing a person to easily remove the jewelry from the cushion for use.

The base layer 14 is preferably formed of thin rigid material such as cardboard or corkboard and is provided to define the shape of the jewelry cushion 10 and to give it a sufficient amount of rigidity. Cardboard or corkboard is preferred because these materials are rigid yet won't bend the posts of jewelry that is pushed against the base layer 14. The preferred base layer 14 is approximately 2–6 inches wide, 4–8 inches long, and ⅛–¼ inches thick.

The intermediate layer 16 is preferably formed of pliable material such as foam rubber and is positioned atop the base layer 14. As described below, the intermediate layer 16 cooperates with the upper layer 18 to firmly hold the posts of jewelry attached to the jewelry cushion 10. Foam rubber material is preferred because it is sufficiently dense to provide a holding force to retain the posts of the jewelry within the jewelry cushion 10 while allowing a person to easily remove the jewelry from the jewelry cushion 10 for use. The preferred intermediate layer 16 presents the same width and length dimensions as the base layer and is approximately ⅛" thick. A second layer of foam rubber material 22 may be positioned below the base layer 14 to conceal the base layer 14 and to give the overall jewelry cushion 10 a softer feel.

The upper layer 18 is preferably formed of sponge material and is positioned atop the intermediate layer 16. The upper layer 18 gives the overall jewelry cushion 10 a soft, flexible feel and cooperates with the intermediate layer 16 to hold the posts of the jewelry to the jewelry cushion 10. The preferred upper layer 18 is formed of open-celled foam sponge material and presents a thickness of ¼–½ inches. The upper layer 18 preferably presents the same width and length dimensions as the base layer 14.

The outer layer 20 envelops the base, intermediate and upper layers 14, 16 and 18 and defines the outermost surface of the jewelry cushion 10. The outer layer 20 is preferably formed of flexible cloth material such as wool, cotton or polyester. The outer layer 20 is wrapped around the layers 14, 16, and 18 and its ends are sewn together to retain the position of the layers. The cloth configuration of the outer layer 20 allows jewelry posts to easily penetrate the jewelry cushion 10 without tearing it. Additionally, the soft cloth surface won't damage the decorative portion of the jewelry which remains on top of the jewelry cushion 10.

As best illustrated in FIG. 6, the outer layer 20 may also include a plurality of loops 24 attached to its upper surface. The loops 24 are formed of thread or string sewn to the outer layer 20 and are provided for receiving and holding larger jewelry such as loop earrings.

In use, the layers 14, 16, 18 and 20 of the jewelry cushion 10 cooperate to firmly hold the posts of the jewelry to the cushion 10 while allowing a person to easily remove the jewelry for use. To attach jewelry to the cushion 10, the pointed posts of the jewelry are pushed through the outer, upper and intermediate layers. The layers grip the jewelry posts and prevent the jewelry from prematurely detaching from the jewelry cushion 10. Larger jewelry such as loop earrings may be attached to the loops 24 on the outer layer 20.

As illustrated in FIG. 2, the carrying case 12 is provided for receiving and enveloping the jewelry cushion 10 to prevent jewelry from dislodging from the jewelry cushion 10 during transport. The carrying case 12 is preferably formed of transparent plastic such as 16 gauge plastic sheet material. To form the carrying case, the plastic sheet material is doubled over, its longitudinal edges are sewn together, and it is then turned inside out to present smooth outermost edges. A cover panel 26 including a pair of velcro type fasteners 28 may be attached to the carrying case 12 for closing the open end of the carrying case 12.

An inner bag (not shown) may be attached to the carrying case 12 for storing the backs of earrings and pins attached to the jewelry cushion 10.

The transparency of the carrying case 12 allows visual inspection of the jewelry held on the cushion 10 when the cushion 10 is placed within the carrying case 12. In this way, jewelry can be observed and counted without removing the jewelry cushion 10 from the carrying case 12.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A jewelry storage apparatus for storing jewelry comprising:

a multilayered jewelry cushion for receiving and holding the jewelry, said cushion including a planar base layer formed of thin rigid cardboard or corkboard material, a planar intermediate layer positioned atop said base layer, said intermediate layer being formed of pliable foam rubber material, a planar upper layer positioned atop said intermediate layer, said upper layer being formed of sponge material, and an outer layer enveloping said base, intermediate and upper layers, said outer layer being formed of flexible cloth material and including a plurality of loops attached thereto for receiving and holding jewelry such as loop earrings; and a carrying case for receiving said cushion, said carrying case being formed of transparent synthetic resin material for allowing visual inspection of the jewelry held on said cushion when said cushion is placed within said carrying case.

2. A multilayered jewelry cushion for receiving and holding jewelry comprising:

a planar base layer;

a planar intermediate layer positioned atop said base layer, said intermediate layer being formed of pliable foam rubber material;

a planar upper layer positioned atop said intermediate layer, said upper layer being formed of sponge material;

an outer layer enveloping said base, intermediate and upper layers for retaining the positioning of said base, intermediate and upper layers; and a sub-base layer formed of pliable foam rubber material positioned below said base layer.

3. A multilayered jewelry cushion for receiving and holding jewelry comprising:

a planar base layer;

a planar intermediate layer positioned atop said base layer, said intermediate layer being formed of pliable foam rubber material;

a planar upper layer positioned atop said intermediate layer, said upper layer being form of sponge material; and an outer layer enveloping said base, intermediate and upper layers for retaining the positioning of said base, intermediate and upper layers, the outer layer including a plurality of loops attached for receiving and holding jewelry such as loop earrings.

* * * * *